United States Patent [19]

Tamary

[11] Patent Number: 4,963,943

[45] Date of Patent: Oct. 16, 1990

[54] FUSING APPARATUS HAVING A HEAT-DISSIPATING DEVICE

[75] Inventor: Ernest J. Tamary, Brighton, N.Y.

[73] Assignee: Eastman Kodak Company, Rochester, N.Y.

[21] Appl. No.: 410,453

[22] Filed: Sep. 21, 1989

[51] Int. Cl.[5] ..... G03G 15/20

[52] U.S. Cl. ..... 355/290; 355/285; 355/289

[58] Field of Search ..... 355/285, 289, 290, 291, 355/208, 30, 298, 295; 219/216

[56] References Cited

U.S. PATENT DOCUMENTS

| | | | |
|---|---|---|---|
| 4,248,520 | 2/1981 | Kurita et al. | 355/30 |
| 4,309,591 | 1/1982 | Kanoto et al. | 219/216 |
| 4,318,612 | 3/1982 | Brannan et al. | 355/30 |
| 4,801,974 | 1/1989 | Suto et al. | 355/290 |

FOREIGN PATENT DOCUMENTS

| | | | |
|---|---|---|---|
| 0034175 | 2/1987 | Japan | 355/208 |
| 0111274 | 5/1987 | Japan | 355/208 |

*Primary Examiner*—A. T. Grimley
*Assistant Examiner*—Sandra L. Hoffman
*Attorney, Agent, or Firm*—Tallam I. Nguti

[57] ABSTRACT

A fusing apparatus operable at a desired fusing temperature through a run period when toner images on a receiver or copy sheet are fused, using up a required and first amount of heat, and through a standby period when the apparatus is awaiting a run period. The fusing apparatus includes a device for selectively dissipating, during the standby period, a desired and second amount of heat approximating the required and first amount of heat used up during the run period. The heat dissipating device thus prevents "droop" or a dropping from the desired fusing temperature, by causing heat flow from the apparatus to remain relatively constant during both run and standby periods. Additionally, such dissipation also advantageously cools the apparatus, thereby preventing the occurrence of heat-related fusing defects such as copy curling, blistering, and image offset.

9 Claims, 1 Drawing Sheet

FUSING APPARATUS HAVING A HEAT-DISSIPATING DEVICE

BACKGROUND OF THE INVENTION

This invention relates to apparatus in electrostatographic copiers or printers for fusing toner images (carried on a suitable receiver or copy sheet) at a desired fusing temperature. More particularly, the present invention relates to a heated fusing apparatus that effectively prevents "droop" or a dropping from such a desired fusing temperature, and that substantially reduces heating of the receiver or copy sheet, thereby preventing the occurrence of heat-related copy sheet defects such as curling, blistering, and image offset.

In electrostatographic copiers and printers, it is well known to use a heated fusing apparatus, for example a heated fuser and pressure roller type apparatus, at a desired fusing temperature, to fuse toner images to a suitable receiver or copy sheet of paper. Normally, such apparatus is operated through a run period when toner images on a receiver or copy sheet are fused, and through a standby period when the apparatus is awaiting a run period. In such apparatus, the pressure roller, which forms a heat transfer or fusing nip with the heated fuser roller, typically includes a rigid thermally conductive shell that can store heat received from the heated fuser roller.

On the other hand, the fuser roller which may include a metallic core that is coated with a thick layer of an elastomeric material, may be heated externally, or internally by a heat source. When heated internally, the heat source is located within the metallic core, and heat therefore must flow from within such core, outwards through its elastomeric coating to its surface, and then across the heat-transfer or fusing nip to the pressure roller.

During the run periods, some of such heat, however, will be absorbed by, and first heat, any toner image-carrying receiver or copy sheet within the nip, before it then reaches the pressure roller. In order to sustain such heat flow, the heat source of the fuser roller must be turned on and off such that the core of the fuser roller remains relatively hotter than its surface, as well as, than the pressure roller. However, if the surface of the pressure roller became relatively hotter than the toner image-carrying receiver or copy sheet being run, heat will additionally flow back, from the pressure roller, into such a receiver or copy sheet.

When using such apparatus for fusing toner images at a desired fusing temperature, such a temperature typically is measured on the surface of the fuser roller, and is controlled by turning the heat source on and off in response to changes in such measured temperature. Normally, in response to such temperature changes, a reduced duty cycle may be initiated for the heat source, or the heat source may be turned off completely, during standby periods. As a result, the duty cycle must be increased or the heat source turned back on, in response to the measured temperature dropping below a particular control setpoint, for example, the fusing setpoint.

"Droop" or a continued dropping from the desired fusing temperature setpoint of the apparatus occurs in part because of such on/off control of the heat source. This is because reducing and increasing the duty cycle, or turning the heat source on and off, as such, does not instantly begin to raise or lower the temperature of the surface of the fuser roller. Instead, when the heat source is turned on in response to the temperature of the fuser roller surface dropping below the desired fusing setpoint, for example, the immediate result is an undesirable continued dropping or "drooping" from such a setpoint. Such continued dropping or "droop" is due in large part to the thermal capacitances and inertia of the core and the elastomeric coating of the fuser roller, and is especially undesirable because it can introduce variations in fusing quality, and if severe, can result in poor and unacceptable images.

Unfortunately too, raising the temperature control setpoint at which to turn the heat source on and off in an attempt to avoid such a "droop" or "drooping" problem may undesirably result in the pressure roller becoming overheated during the standby periods. Such an overheated pressure roller will substantially increase the amount of heat that will be transferred back by such pressure roller to the receivers or copy sheets being run, for example, at the start of an ensuing run period. Such backtransfer of heat will equally overheat the receivers or copy sheets, and consequently risk the occurrence of heat-related defects such as curling, blistering, and image offset.

SUMMARY OF THE INVENTION

It is therefore an object of the present invention to provide a fusing apparatus that substantially reduces variations in fusing quality by preventing "droop" or a dropping from its desired fusing temperature.

It is also an object of the present invention to provide a fusing apparatus that in addition substantially reduces overheating of receivers or copy sheets, thereby preventing the occurrence of heat-related copy sheet defects such as curling, blistering, and image offset.

In accordance with the present invention, a fusing apparatus is operable through a run period when toner images on a receiver or copy sheet are fused, using up a required and first amount of heat, and through a standby period when the apparatus is awaiting a run period. The fusing apparatus includes (i) a fusing member, (ii) means for heating the fusing member to a desired fusing temperature, (iii) a nip forming member in heat relationship with the fusing member during both run and standby periods, and (iv) means for selectively dissipating a desired and second amount of heat from the nip forming member during standby periods, in order to prevent "droop" or a dropping from the desired fusing temperature by causing the heat flow from the fusing member to remain relatively constant during both run and standby periods.

BRIEF DESCRIPTION OF THE DRAWINGS

In the detailed description of the preferred embodiment of the present invention below, reference is made to the accompanying drawing, in which.

DESCRIPTION OF THE PREFERRED EMBODIMENT

Figure 1:
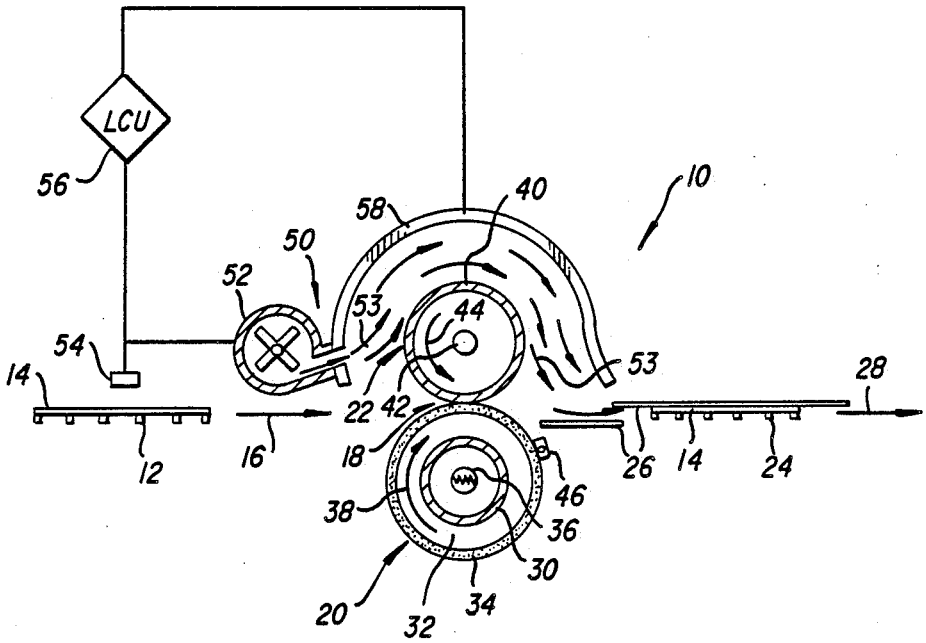
FIG. 1 is a schematic of the fusing apparatus of the present invention.

In the accompanying drawing, a heat fusing apparatus is designated generally as 10, and is suitable for fusing loose toner images 12 being carried on a suitable receiver or copy sheet 14. To accomplish such fusing, the receiver or copy sheet 14 is fed, during a run period and in the direction of arrow 16, through a fusing nip 18. The nip 18 is formed by a heated fusing member such as a fuser roller 20, and a nip forming member such as a pressure roller 22.

After such fusing, the receiver or copy sheet 14, with fused toner images 24 thereon, can then be transported away from the fusing apparatus 10 in the direction of arrow 28, against a transport surface 26. When no more receivers or copy sheets are ready for running, the apparatus 10 will go through a standby period during which it is in a standby mode awaiting the next run period.

As illustrated, the fuser roller 20 may consist of a hollow, thermally conductive core 30 which is coated by a thick compliant layer 32 of elastomeric material. The coating 32 may have an outer surface 34 that is also compliant and is suitable for contacting the toner images 12 being fused so as to produce a desired finish on the fused images 24. Fuser roller 20 is rotatable in the direction of arrow 38, and may be externally or internally heated. As shown, it is heated internally by a heat source 36, such as a quartz lamp that is mounted within the hollow of the core 30. Heat flow, therefore, is from within, through the core 30, and through the coating 32, to its outside surface 34.

On the other hand, the nip forming member or pressure roller 22, as illustrated is unheated, and may include a rigid, thermally-conductive metallic shell 40. The shell 40, which is rotatable in the direction of arrow 44, is mounted on a shaft 42 such that it is in heat receiving relationship with the hot surface 34 of the fuser roller 20 during both run and standby periods.

The temperature of the surface 34 of the fuser roller 20 may be sensed, for example, by means of a temperature sensing device 46. It then can be controlled at a predetermined and desired fusing setpoint during run periods, and at a different predetermined setpoint during standby periods. Such control is achieved by turning the heat source 36 on and off responsively to changes, in the measured temperature, relative to such predetermined control setpoints.

During run periods when toner image-carrying receivers or copy sheets 14 are being fed through the nip 18, heat from the fuser roller 20 additionally will be absorbed by such receivers or copy sheets 14. However, during standby periods, the heat will flow without such absorption, into and across the nip 18, before reaching the pressure roller 22. With no heat-absorbing receivers or copy sheets 14 within the nip 18 during such standby periods, substantially all the heat transferred by the fuser roller will pass to the pressure roller, thereby making it more likely that the surface of the pressure roller 22 will quickly reach the same temperature as that of the surface 34 of the fuser roller 20. As a consequence, it then becomes more likely for the heat source 36 to be turned off, or its duty cycle reduced, during standby periods than during run periods. The result of course will be a temperature, during standby periods, that is less than the desired fusing temperature. Therefore, by the beginning of an ensuing run period the heat source 36 must be turned back on, or its duty cycled increased, in order to attempt to raise the temperature of the surface 34 back to such desired fusing temperature.

Ordinarily however, such heat on and heat off method of controlling the surface temperature of the fuser roller 20 will result in, or contribute to the problem of "droop", as it is described above.

As discussed above, the temperature response of the surface 34 (of the fuser roller 20) to the heat source 36 being turned on, for example, will ordinarily not be instantaneous. Instead, there will be a delay, usually resulting in "droop" or a continued dropping of the temperature of the surface 34 below the desired control setpoint even after the heat source 36 has been turned on. Turning the heat source 36 off and back on as described, is therefore a significant and contributing factor to the problem of "droop".

"Droop" as a problem, however, can not be solved merely by not turning the heat source off and back on as described above, or by raising the setpoint at which the temperature of the surface 34 may be controlled. This is because keeping the heat source constantly on, or raising the temperature control setpoint in this manner, will ordinarily increase the amount of heat flow from the fuser roller 20 into the pressure roller 22, particularly during the standby periods. Such increased heat flow to the pressure roller 22 will, of course, build up in, and likely overheat the pressure roller. An overheated pressure roller will, during an ensuing run period, transfer such heat back to, and equally overheat the receivers or copy sheets 14 being run. Overheating such receivers or copy sheets will doubtless cause heat-related defects, such as curling and blistering.

Furthermore, such overheating of the receivers or copy sheets is also likely to cause image offset problems in double pass or duplex operations in which images on a first side of a receiver or copy sheet are first fused, and then images on a second side of the same receiver or copy sheet are next fused. The image offset problem occurs because during the subsequent fusing on such second side, the overheated pressure roller undesirably reheats and remelts the already fused images on such first side of the receiver or copy sheet. Such remelting usually causes image disruptions and image offset from such first side, back to the pressure roller 22.

The apparatus 10 of the present invention substantially prevents these problems, namely, the problem of "droop" and heat-related defects such as curling, blistering, and image offset. For doing so, the apparatus 10 includes heat dissipating means 50 for actively and selectively dissipating a desired and second amount of heat from the nip forming member or pressure roller 22 during standby periods. As illustrated, the heat dissipating means 50 includes a cooling device 52 that has a cooling element 53 which can be put into, and out of cooling contact with the surface of the pressure roller 22. The cooling element 53, can be a chilled roller on an articulating bracket (not shown), or as preferably shown, it can be cooled air 53 blown by the air moving cooling device 52. The cooling element or cooled air 53, as shown, should be capable of directly contacting and instantly cooling the nip forming member or pressure roller 22 during the standby periods.

Upon leaving the fusing apparatus 10, the cooled air, in this particular embodiment which by then is relatively warm, may be directed, for example, against a copy sheet transport plate 26 for conditioning the surface of such plate.

The apparatus 10 overall, and in particular the heat dissipating means 50, can be controlled by means, for example, of a sensor 54 cooperating with the a programmable logic and control unit 56. The sensor 54 is for detecting the presence or absence of an incoming receiver or copy sheet 14. Signals generated by sensor 54 can thus be used by the control unit 56 to detect the beginning of each run, and each standby period.

The heat dissipating means 50 as such includes means such as the sensor 54 cooperating with the control unit 56 for selectively activating the cooling device 52 in timed relation to the apparatus 10 beginning a standby period, as well as for inactivating the same in timed relation to the apparatus 10 beginning a run period. Accordingly, the cooling device 52 can thus be selectively turned on, and if necessary, kept on during each standby period for dissipating heat from, and cooling the pressure roller 22. In addition, the cooling device 52 can also be selectively turned off, and kept off, during each run period.

The temperature of the cooling element, for example the air stream 53, should be controlled so as to effectively cool the pressure roller 22 to a desired point. For example, the temperature should be maintained at a point where the pressure roller 22 is drawing and dissipating the desired and second amount of heat from the surface 34 of the fuser roller. Such a desired and second amount of heat should be approximately or substantially equal to the required or first amount of heat expected to be, or that would have been, absorbed by the toner image-carrying receivers or copy sheets 14 during each run period.

As such, the desired amount of heat being dissipated from the pressure roller 22 by the means 50 during standby periods, merely simulates the presence of such toner image-carrying receivers or copy sheets 14 during such periods. Such simulation will of course cause the heat source 36 to continue, during such standby periods, to operate at approximately the same level as it does during run periods, and hence the heat flow therefrom to remain relatively constant during both standby and run periods.

As a consequence, the temperature of the surface 34 of the fuser roller 20 will remain substantially at the desired fusing setpoint during both standby and run periods. Additionally, the heat source 36 will no longer be more likely to be turned off during standby periods than it is during run periods. The problems of "droop" which typically follows the practice of turning the fuser roller heat source off and then back on again, will be accordingly and effectively prevented.

Furthermore, it is important that despite the operation of the the heat dissipating means 50 and the heat source 36, as described, for maintaining a relatively constant heat flow during both standby and run periods, desired fusing results will not be detrimentally affected. This is so because, despite the greater or increased heat flow to the pressure roller 22 during such standby periods, direct cooling of the pressure roller 22 by the cooling element, such as the cooled air stream 53, effectively prevents undesirable overheating of the pressure roller 22. Such direct cooling of course means that receivers or copy sheets 14 will not be overheated during ensuing run periods, and that such receivers or copy sheets will not be subjected to the risks of heat-related defects such as curling, blistering, and image offset.

As shown, the air dissipating means 50 further includes an arcuate air-deflector 58 which is mounted, spaced from, and partially surrounding the pressure roller 22, to the side away from the fusing nip 18. Mounted as such, the deflector 58 creates and maintains a passage way for the air stream 53 flowing over the surface of the pressure roller 22.

As can be seen, the apparatus 10, including the heat dissipating means 50, is suitable for fusing toner images without variations in fusing quality due to "droop" or continued dropping from its desired fusing temperature. Additionally, the effective cooling of the pressure roller during such standby periods advantageously prevents the occurrence of heat-related fusing defects such as curling, blistering and image offset.

Although the description of the invention has been made with particular reference to a preferred embodiment, it is understood that variations and modifications thereto can be effected within the scope and spirit of the invention.

I claim:

1. In an electrostatographic copier or printer, a fusing apparatus operable through a run period when toner images on a receiver or copy sheet are fused, using up a required and first amount of heat, and through a standby period when the apparatus is awaiting a run period, the apparatus including:

(a) a fusing member;

(b) means for heating said fusing member to a desired fusing temperature;

(c) a nip forming member in heat receiving relationship with said fusing member during both the run and standby periods;

(d) means for selectively dissipating a desired and second amount of heat from said nip forming member during standby periods in order to prevent "droop", or a dropping from the desired fusing temperature by causing heat flow from said fusing member to remain relatively constant during both run and standby periods; and (e) means for selectively activating said heat dissipating means in timed relation to said apparatus beginning a standby period, and inactivating the same in timed relation to said apparatus beginning a run period.

2. The apparatus of claim 1 wherein said fusing member is a fuser roller.

3. The apparatus of claim 1 wherein said nip forming member is a pressure roller.

4. The apparatus of claim 1 wherein said heat dissipating means includes a cooling element that can be put into, and out of cooling contact with the surface of the pressure roller.

5. The apparatus of claim 1 wherein said heat dissipating means further includes:

(a) a device for blowing cooled air directly against said pressure roller during the standby period; and (b) an air-deflector plate mounted spaced from, and partially surrounding said pressure roller, thereby creating and maintaining a passage way over the surface of said pressure roller.

6. The apparatus of claim 1 wherein said heat dissipating means is effective in dissipating an amount of heat from said nip forming member during standby periods that approximates an amount of heat expected to be dissipated from said fusing member by a toner image carrying receiver or copy sheet during run periods, thereby maintaining relatively constant heat flow from said fusing member during run and standby periods.

7. The apparatus of claim 4 wherein said cooling element consists of cooled air being blown by an air moving device.

8. The apparatus of claim 4 including means for selectively controlling said cooling element such that it is on, and dissipating heat from said pressure roller, during the standby period, and is off during the run period.

9. A fusing apparatus operable through a run period when toner images on a receiver or copy sheet are fused, and through a standby period when the apparatus is awaiting a run period, the apparatus comprising:

(a) a fuser roller including a heat source for heating said fuser roller to a desired fusing temperature, said fuser roller having a required and first amount of heat flow therefrom being absorbed during a run period by the toner image-carrying receiver or copy sheet;

(b) a pressure roller in heat receiving relationship with said heated fuser roller during both the run and standby periods;

(c) means, useful during the standby period, for selectively dissipating a desired and second amount of heat received by said pressure roller such that said desired and second amount of heat approximates said required or first amount of heat flow therefrom during the run period; and (d) means for selectively activating said heat dissipating means in timed relation to said apparatus beginning a standby period, and inactivating the same in timed relation to said apparatus beginning a run period.

* * * * *